US010030861B2

(12) United States Patent
Midali et al.

(10) Patent No.: US 10,030,861 B2
(45) Date of Patent: Jul. 24, 2018

(54) COOLING ASSEMBLY FOR COOLING AT LEAST ONE LIGHT SOURCE OF A LIGHT FIXTURE AND LIGHT FIXTURE COMPRISING SAID COOLING ASSEMBLY

(71) Applicant: CLAY PAKY S.p.A., Seriate (IT)

(72) Inventors: Roberto Midali, Torre Boldone (IT); Mosè Benaglia, Villa di Serio (IT)

(73) Assignee: CLAY PAKY S.P.A., Seriate (IT)

( * ) Notice: Subject to any disclaimer, the term of this patent is extended or adjusted under 35 U.S.C. 154(b) by 10 days.

(21) Appl. No.: 15/097,777

(22) Filed: Apr. 13, 2016

(65) Prior Publication Data

US 2016/0305639 A1 Oct. 20, 2016

(30) Foreign Application Priority Data

Apr. 16, 2015 (IT) ..... MI2015A0554

(51) Int. Cl.

| | |
|---|---|
| ***F21V 29/00*** | (2015.01) |
| ***F21V 29/60*** | (2015.01) |
| ***F21V 29/503*** | (2015.01) |
| ***F21V 29/67*** | (2015.01) |
| *F21W 131/406* | (2006.01) |

(52) U.S. Cl.

CPC ..... *F21V 29/60* (2015.01); *F21V 29/503* (2015.01); *F21V 29/67* (2015.01); *F21V 29/677* (2015.01); *F21W 2131/406* (2013.01)

(58) Field of Classification Search

CPC ..... F21V 29/60; F21V 29/503; F21V 29/67; F21V 29/677; F21V 29/02; F21W 2131/406

See application file for complete search history.

(56) References Cited

U.S. PATENT DOCUMENTS

| | | | | |
|---|---|---|---|---|
| 5,626,416 | A | 5/1997 | Romano et al. | |
| 8,616,707 | B2 * | 12/2013 | Miyazawa et al. | G03B 21/16 353/58 |
| 2004/0145896 | A1 * | 7/2004 | Watanabe et al. | F21V 29/02 362/294 |
| 2005/0225963 | A1 * | 10/2005 | Huang et al. | F21V 29/02 362/96 |
| 2006/0256296 | A1 | 11/2006 | Yun et al. | |
| 2007/0029907 | A1 * | 2/2007 | Verstraeten | F21V 29/60 362/373 |
| 2010/0231867 | A1 | 9/2010 | Takezawa | |
| 2011/0032491 | A1 | 2/2011 | Tsai et al. | |
| 2011/0216287 | A1 | 9/2011 | Kitamura et al. | |
| 2011/0249443 | A1 * | 10/2011 | Jurik | F21V 3/02 362/294 |
| 2012/0287408 | A1 | 11/2012 | Yamashita | |

FOREIGN PATENT DOCUMENTS

| | | |
|---|---|---|
| EP | 2 623 860 | 8/2013 |
| JP | 2002 025305 | 1/2002 |

* cited by examiner

*Primary Examiner* — Y M. Lee
(74) *Attorney, Agent, or Firm* — Leason Ellis LLP

(57) ABSTRACT

A cooling assembly for cooling at least one light source of a light fixture is provided with at least a cooling fan configured to generate a cooling air flow; and at least with a flow-guiding element configured to convey the cooling air flow of the cooling fan and divide it into a primary flow adapted to mainly cool a first zone of the light source and at least a secondary flow adapted to mainly cool a second zone of the light source, at least partially distinct from the first zone.

13 Claims, 4 Drawing Sheets

COOLING ASSEMBLY FOR COOLING AT LEAST ONE LIGHT SOURCE OF A LIGHT FIXTURE AND LIGHT FIXTURE COMPRISING SAID COOLING ASSEMBLY

CROSS-REFERENCE TO RELATED PATENT APPLICATIONS

The present application claims the benefit of priority under 35 U.S.C. § 119 of Italian patent application serial No. MI2015A000554, filed Apr. 16, 2015, which is hereby incorporated by reference in its entirety.

The present invention relates to a cooling assembly for cooling at least a light source of a light fixture and a light fixture comprising said cooling assembly.

Preferably, the cooling assembly is configured to cool at least a light source of a stage light fixture.

BACKGROUND OF THE INVENTION

The stage light fixtures of known type, in fact, comprise at least one light source configured to generate a light beam and a plurality of light beam processing elements configured to selectively process the light beam according to the stage requirements. The light source and the light beam processing elements are generally housed in a casing and generate heat inside the casing.

The heat accumulated inside the casing can excessively heat the light source and the remaining components of the light fixture, with the risk of permanent damage. For these reasons, the majority of stage light fixtures includes a cooling system capable of removing the heat generated inside the casing. However, the normally used cooling systems cannot always correctly cool the casing interior. Sometimes, in fact, an insufficient cooling or an excessive cooling has irreparable consequences, which mostly determine a reduction of the duration of the light source or even the breakage of the light source.

SUMMARY OF THE INVENTION

It is therefore an object of the present invention to provide a cooling assembly which is free from the aforesaid drawbacks of the prior art. In particular, it is an object of the present invention to provide a cooling assembly for cooling at least a light source of a light fixture which can suitably cool the light source during use, so as to ensure an adequate durability and reliability.

According to these objects, the present invention relates to a cooling assembly for cooling at least a light source of a light fixture comprising:

- at least one cooling fan configured to produce a cooling air flow;
- at least one flow-guiding element configured to guide the cooling air flow of the cooling fan and divide it into a primary air flow, able to mainly cool a first zone of the light source, and at least a secondary air flow, able to mainly cool a second zone of the light source, at least in part distinct from the first zone.

It is also an object of the present invention to provide a reliable and long-lasting light fixture.

According to these objects, the present invention relates to a light fixture comprising a casing, a light source arranged inside the casing and able to produce a light beam, and a cooling assembly for cooling at least a light source of a light fixture; the cooling assembly comprising:

- at least one cooling fan configured to produce a cooling air flow;
- at least one flow-guiding element configured to guide the cooling air flow of the cooling fan and divide it into a primary air flow, able to mainly cool a first zone of the light source, and at least a secondary air flow, able to mainly cool a second zone of the light source, at least in part distinct from the first zone.

BRIEF DESCRIPTION OF THE DRAWINGS

Further characteristics and advantages of the present invention will become clear from the following description of a non-limiting embodiment, with reference to the figures of the accompanying drawings, in which.

DETAILED DESCRIPTION OF THE INVENTION

Figure 1:
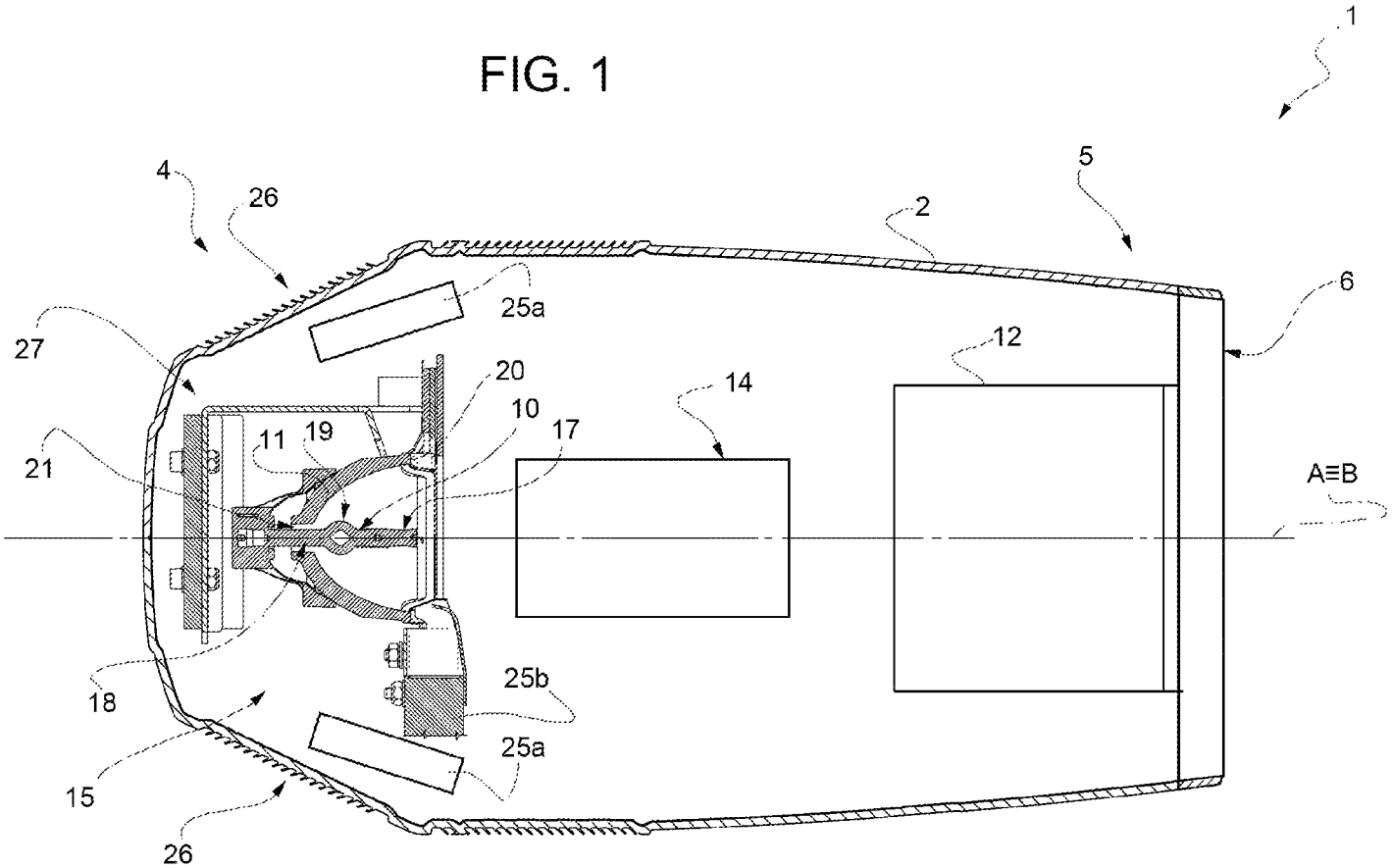
FIG. 1 is a first schematic side view with parts in section and parts removed for clarity's sake, of a light fixture according to the present invention.

In FIG. 1, the reference number 1 indicates a stage light fixture comprising a casing 2 and support means (not shown in the accompanying figures) configured to support the casing 2. Preferably, the support means are configured to move the casing 2 and to allow its rotation about two orthogonal axes, commonly said PAN and TILT. The operation of the support means is regulated by a motion control device (not visible in the accompanying figures). The motion control device can also be used remotely, preferably through communications with a DMX protocol.

According to a variant, the support means may be configured only to support the casing 2, without allowing its movement.

The casing 2 extends along a longitudinal axis A and is provided with a first closed end 4 and with a second end 5, opposite to the first closed end 4 along the axis A, and provided with a projection mouth 6. In the non-limiting example here described and shown, the projection mouth 6 has a substantially circular section.

The light fixture 1 further comprises a frame 9 coupled to the casing 2 (not shown for simplicity's sake in FIG. 1 and partially visible in FIGS. 2 and 3), a light source 10, a reflector 11, an optical assembly 12 (schematically shown in FIG. 2), beam processing means 14 (schematically shown in FIG. 2) and a cooling assembly 15.

Figure 2:
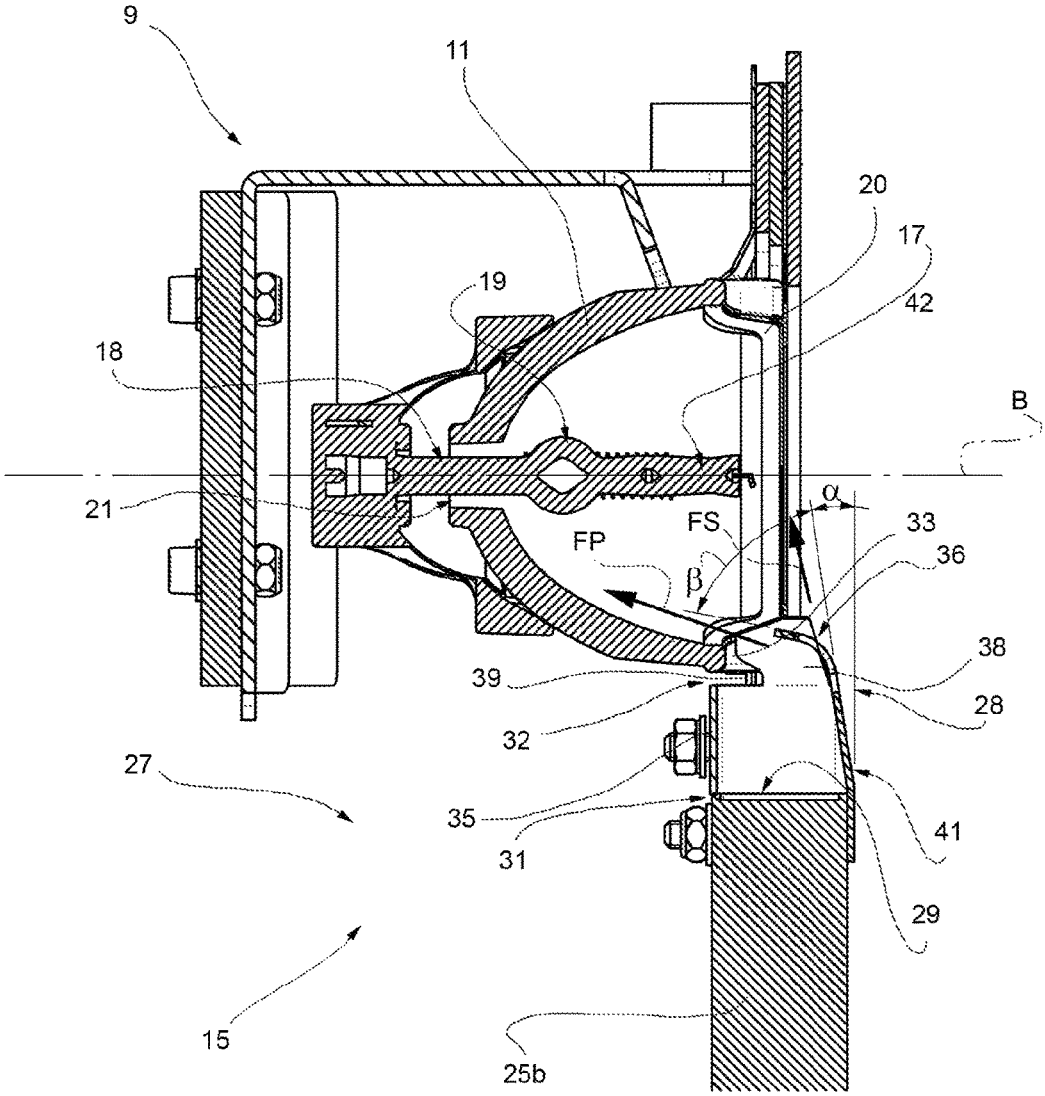
FIG. 2 is a second schematic side view, with parts in section and parts removed for clarity's sake, of a first detail of the light fixture of FIG. 1.
Figure 3:
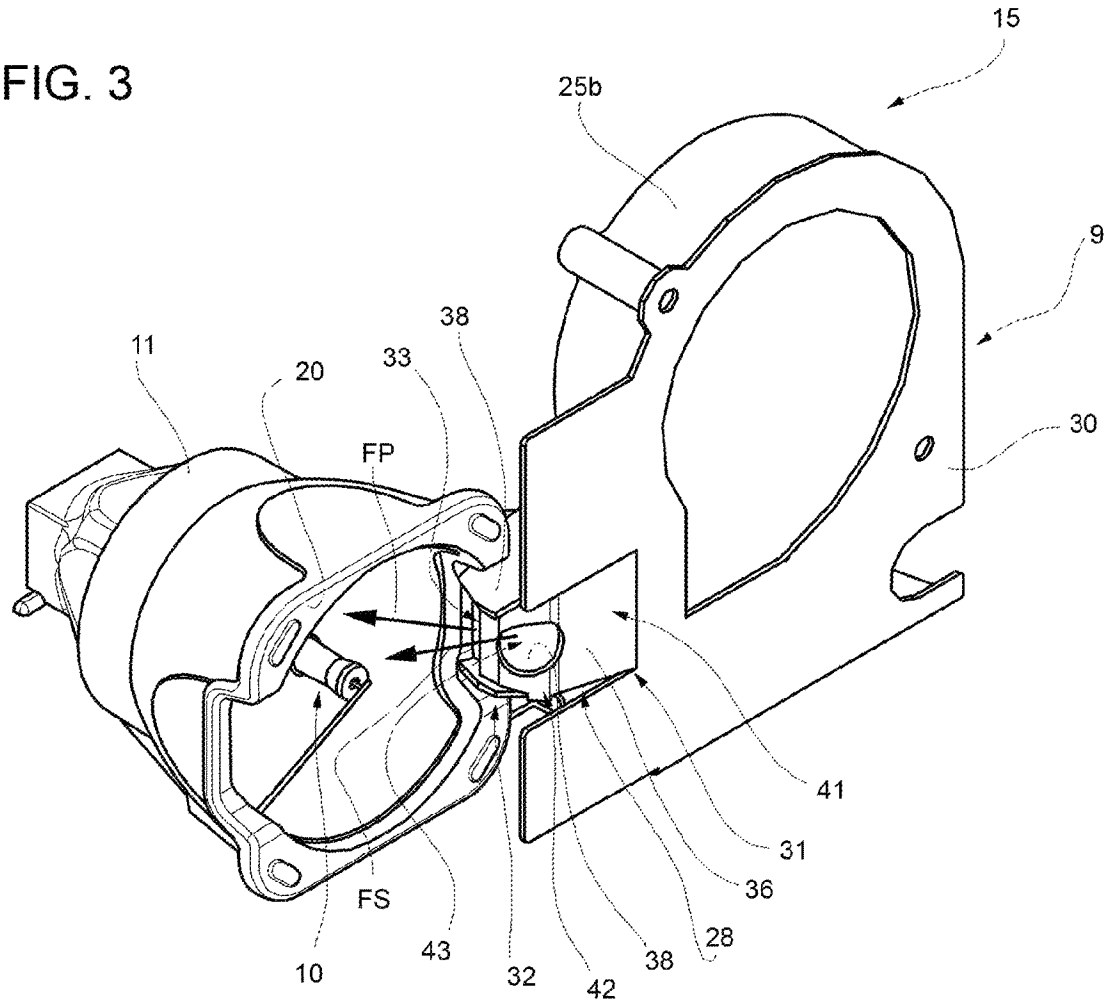
FIG. 3 is a schematic perspective view, with parts removed for clarity's sake, of a second detail of the stage light fixture of FIG. 1.

The frame 9 is integral with the casing 2 and comprises a plurality of elements coupled to each other and configured to define a support structure for the components arranged within the casing 2, such as the light source 10, the reflector 11, the optical assembly 12, the beam processing means 14 and the cooling assembly 15. FIG. 2 and FIG. 3 partially show some of the elements of the frame 9 configured to support the light source 10, the reflector 11 and, as shown in more detail below, the cooling assembly 15.

With reference to FIG. 1 and to FIG. 2, the light source 10 is arranged inside the casing 2 at the closed end 4 of the casing 2, is supported by the frame 9, and is adapted to emit a light beam substantially along an optical axis B.

In the non-limiting example here described and shown, the optical axis B coincides with the longitudinal axis A of the casing 2.

The light source 10 is preferably a discharge lamp made of glass or quartz and containing mercury and halides.

The discharge lamp is preferably a short arc lamp extending along the optical axis B and comprising a front tubular portion 17, a rear tubular portion 18 axially opposite to the front tubular portion 17, and a central bulb 19 arranged between the front tubular portion 17 and the rear tubular portion 18.

Two electrodes connected to a power supply circuit (not visible in the accompanying figures) are arranged inside the bulb 19, at a determined distance. The distance between the electrodes is less than approximately 2 mm. In the non-limiting example here described and shown, this distance is about 1.3 mm.

In the non-limiting example here described and shown, the short arc lamp 10 has a power greater than about 400 watts.

The reflector 11 is a reflector, preferably elliptical, coupled to the light source 10 and having an outer edge 20.

Preferably, the reflector 11 is provided with a central hole 21 housing the rear tubular portion 18 of the light source 10.

With reference to FIG. 1, the optical assembly 12 is arranged in correspondence with the open end 5 of the casing 2, is centred on the optical axis B, is the last assembly able to process the intercepted light beam and, preferably, closes the casing 2.

The optical assembly 12 includes one or more lenses (not shown in the attached figures). Preferably, the optical assembly 12 is movable along the optical axis B to adjust the focus of the projected image.

Preferably, the optical assembly 12 includes a support frame coupled to a carriage movable along the optical axis B (not shown for simplicity's sake), whose movement is regulated by an auto focus device (known and not shown).

The light beam processing means 14 comprise a plurality of light beam processing elements 9 supported by the frame and configured to process the light beam generated by the light source 10 so as to obtain particular effects. In particular, the beam processing elements are supported and/or configured to selectively intercept the light beam and to change it only if necessary. In other words, the beam processing elements can intercept the beam to change its properties only if necessary.

The location of each of the beam processing elements is regulated by a control device of the beam processing means (not visible in the accompanying figures). The control device of the beam processing elements can also be managed remotely, preferably through communications with a DMX protocol.

The light beam processing means 14 may include one or more processing elements selected from the group comprising a dimmer, a colour group, a gobo wheel, a rainbow device, an effects wheel, a frost group and a prismatic element. It is clear that the light beam processing means 14 can include further beam processing elements not listed here.

The cooling assembly 15 comprises a plurality of cooling fans 25 (schematically represented in FIG. 1), variously arranged inside the casing 2 and supported by the frame 9.

Preferably, the cooling fans 25 are governed by a control device (not shown), which regulates the activation and, preferably, the rotation speed.

Preferably, the control device of the cooling assembly 15 is configured to adjust the activation and/or the speed of the cooling fans 25 on the basis of one or more parameters of the light fixture 1, such as the detected position of the casing 2, the detected temperature inside the casing 2, the temperature outside the casing, the actual power of the light source 10, etc.

In the non-limiting example here described and shown, the cooling fans 25 are three. The cooling assembly 15 comprises two cooling fans 25*a* arranged at a respective air vent 26 formed along the wall of the casing 2, a cooling fan 25*b* beside the light source 10 and a flow-guiding element 28 configured to direct the air flow generated by the cooling fan 25*b* and visible only in FIGS. 2, 3 and 4.

The cooling fans 25*a* are symmetrical with respect to the longitudinal axis A of the casing 2 and are respectively configured, the one to convey the air drawn from the respective air vent 26 in a zone 27 of the casing 2 comprised between the end 4 of the casing 2 and the outer portion of the reflector 11, and the other to ease the air escape through the respective air vent 26, thus favouring the cooling air exchange and optimizing the cooling effect.

Figure 4:
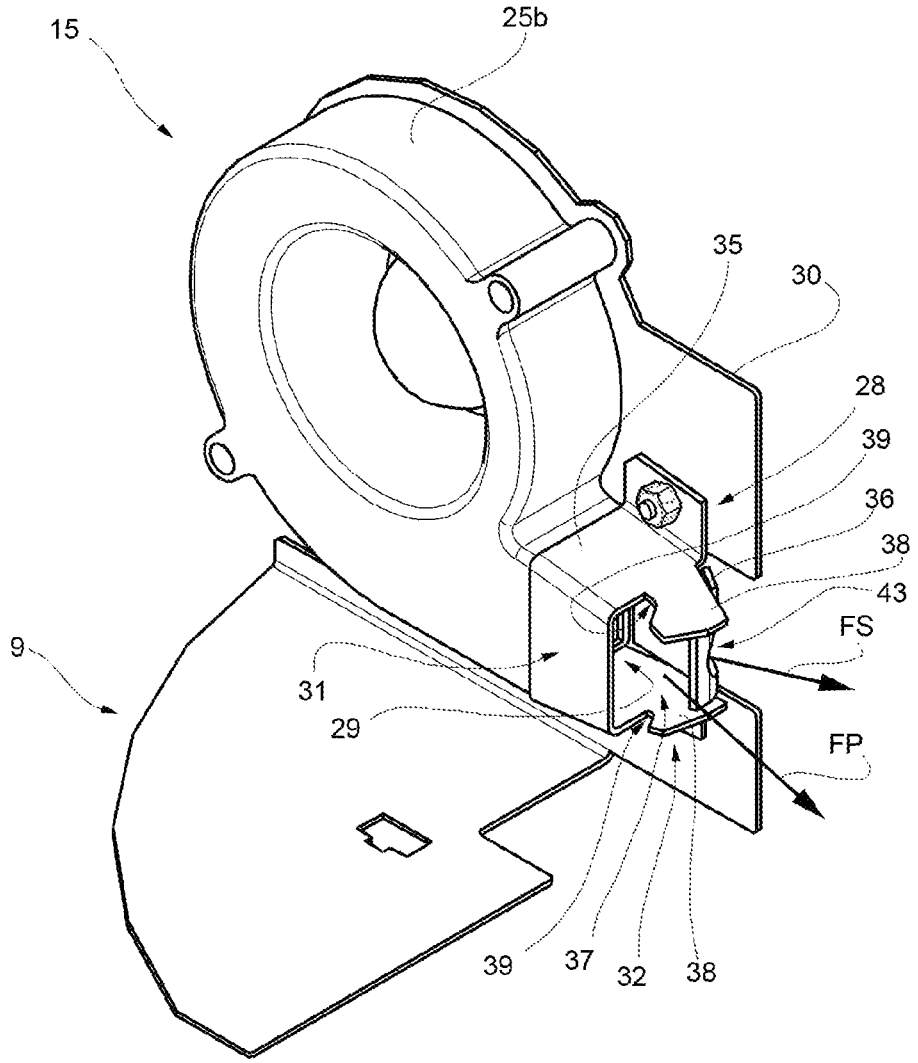
FIG. 4 is a schematic perspective view, with parts removed for clarity's sake, of a third detail of the stage light fixture of FIG. 1.

With reference to FIGS. 2, 3 and 4, the cooling fan 25*b* is substantially coupled to the outer edge 20 of the reflector 11 and is configured to generate a cooling air flow drawn from the zone 27 between the end 4 of the casing 2 and the outer portion of the reflector 11 and to convey it through an outlet 29.

The flow-guiding element 28 is arranged between the outlet 29 of the cooling fan 25*b* and the outer edge 20 of the reflector 11.

The cooling fan 25*b* and the flow-guiding element 28 are supported by a supporting plate 30 of the frame 9 (visible in FIG. 3 and in FIG. 4).

In particular, the flow-guiding element 28 is provided with a first end 31 coupled to the outlet 29 and with a second end 32 coupled to a recess 33 formed along the edge 20 of the reflector 11.

With reference to FIGS. 2-4, the flow-guiding element 28 is formed so as to generate a primary flow FP and at least a secondary flow FS (schematically represented by the arrows of FIG. 2). The primary flow PF is adapted to mainly cool a first zone of the light source 10, whereas the secondary flow FS is adapted to mainly cool a second zone of the light source, at least partially distinct from the first zone.

In particular, the flow-guiding element 28 is formed so as to generate a primary flow FP which is directed so as to cool the bulb 19 and the rear tubular portion 18 of the light source 10 and a secondary flow FS which is directed so as to cool the front tubular portion 17 of the light source 10. The flow guiding element 28 comprises a channel 37 which receives the cooling air from the cooling fan 25*b* and a main fin 36, which is arranged inside the channel 37 and shaped so as to generate the primary flow FP and the secondary flow FS.

In the non-limiting example here described and shown, the flow-guiding element 28 comprises a plate 35, substantially C-folded, and a main fin 36, arranged to form the channel 37, together with the folded plate 35.

With particular reference to FIGS. 3 and 4, the flow-guiding element 28 comprises two further lateral fins 38, coupled to opposite sides of the folded plate 35 and shaped so as to be coupled to the recess 30 of the edge 20 of the reflector 11. In particular, each lateral fin 38 is formed so as to define, together with the plate 35, a seat 39 adapted to be engaged by the edge 20 of the reflector 11.

With particular reference to FIGS. 2 and 3, the main fin 36 comprises a first portion 41 and a second portion 42.

The first portion 41 is inclined with respect to the supporting plate 30 at a first angle α, whereas the second portion 42 is inclined with respect to the first portion at a second angle β.

The first angle α is comprised between 6° and 12° and is preferably equal to 9°±0.5°.

The second angle β is comprised between 60° and 85° and is preferably equal to 70°±0.5°.

The second portion 42 preferably includes a curved portion proximal to the first portion 41 and having a radius of curvature preferably comprised between 5 mm and 7 mm, preferably 6 mm.

The second portion 42 is further provided with a through hole 43.

The size of the hole 43 mainly depends on the type of used light source 10.

A variant not shown provides that the second portion is provided with a plurality of suitably arranged and sized holes.

A variant not shown provides that the flow-guiding element 28 is configured so that the deflection of the first portion 41 and/or of the second portion 42 and, in case, even the hole section 43 can be manually or automatically adjusted, according to the cooling requirements of the used light source 10.

In use, the so configured flow-guiding element 28 determines a division of the air flow produced by the cooling fan 25*b* in the primary flow FP conveyed by the plate 35 and by the main fin 36 and the secondary flow FS passing through the hole 43.

A variant not shown provides that the flow-guiding element 28 can divide the air flow produced by the cooling fan 25*b* in a primary flow FP and in a secondary flow FS thanks to the presence of at least one fin provided with a forked portion in which each fork has a respective appropriate deflection. According to this variant, the flow-guiding element 28 may be preferably configured so that the deflection of each fork can be manually or automatically adjusted, according to the cooling requirements of the used light source 10.

A further variation not shown of the flow-guiding element 28 provides the use of two or more separate fins, having different deflections and arranged along the flow escaping from the outlet 29 of the cooling fan 25*b*. According to this variant, the flow-guiding element 28 may be preferably configured so that the deflection of each separate fin can be manually or automatically adjusted, according to the cooling requirements of the used light source 10.

A variant not shown provides that the flow-guiding element 28 is at least partially made of a transparent material. In this way, the flow-guiding element may also be arranged at the light source 10 and may possibly intercept the light beam without affecting its optical properties.

A further variant not shown provides that the flow-guiding element 28 is at least partially made of an optically active material. In this way, the flow-guiding element may also be arranged at the light source 10 to intercept the light beam and change its optical properties.

A further variant not shown provides that the flow-guiding element 28 is at least partially made of a bimetallic material and/or of a shape memory metal.

A further variant not shown provides that the flow-guiding element 28 includes at least one noise-attenuating device configured to minimize the disorder-related noise.

Advantageously, the cooling assembly 15 according to the present invention can suitably cool the light source 10 by ensuring adequate durability and reliability of the light fixture 1. Thanks to the presence of the flow-guiding element 28 arranged between the cooling fan 25*b* and the reflector 11, in fact, the light source 10 is evenly cooled, thus avoiding the risk of localized overheating that may jeopardize the functioning of the light source 10.

Finally, it is evident that the cooling assembly and the light fixture described here can be modified and varied without departing from the scope of the appended claims.

The invention claimed is:

1. Cooling assembly for cooling at least one light source of a light fixture comprising:

at least one cooling fan configured to produce a cooling air flow; and at least one flow-guiding element configured to guide the cooling air flow of the cooling fan and divide it into a primary air flow, able to mainly cool a first zone of the light source, and at least a secondary air flow, able to mainly cool a second zone of the light source, at least in part distinct from the first zone;

wherein the cooling fan and the flow-guiding element are supported by a supporting plate of the light fixture;

wherein the flow-guiding element comprises at least one main fin provided with a first portion and a second portion arranged in succession along the cooling air flow direction;

wherein the second portion is provided with at least one through hole.

2. Cooling assembly according to claim 1, wherein the second portion is inclined with respect to the first portion at an angle.

3. Cooling assembly according to claim 2, wherein the angle is comprised between 60° and 85°.

4. Cooling assembly according to claim 3, wherein the angle is equal to 70°.

5. Cooling assembly according to claim 1, wherein the second portion comprises a curved section proximal to the first portion.

6. Cooling assembly according to claim 1, wherein the flow-guiding element comprises a plate substantially C-folded and arranged so as to define a channel with the at least one main fin.

7. Cooling assembly according to claim 6, wherein the flow-guiding element comprises two further lateral fins coupled to the opposite sides of the plate and shaped so as to be coupled to the light source.

8. Cooling assembly according to claim 1, wherein the flow-guiding element comprises two or more distinct fins having different deflections and arranged along the cooling air flow of the cooling fan.

9. Cooling assembly according to claim 1, comprising at least two further cooling fans arranged at opposite sides of the light source; one of the further cooling fans being configured to produce a further cooling air flow towards the light source; the other of the further cooling fans being configured to evacuate the further cooling air flow outside the light fixture.

10. Light fixture comprising a casing, the light source arranged inside the casing and able to produce a light beam, and a cooling assembly as claimed in claim 1.

11. Cooling assembly for cooling at least one light source of a light fixture comprising:

at least one cooling fan configured to produce a cooling air flow; and at least one flow-guiding element configured to guide the cooling air flow of the cooling fan and divide it into a primary air flow, able to mainly cool a first zone of the light source, and at least a secondary air flow, able to mainly cool a second zone of the light source, at least in part distinct from the first zone;

wherein the cooling fan and the flow-guiding element are supported by a supporting plate of the light fixture;

wherein the flow-guiding element comprises at least one main fin provided with a first portion and a second portion arranged in succession along the cooling air flow direction;

wherein the first portion is inclined with respect to the supporting plate at a angle.

12. Cooling assembly according to claim 11, wherein the angle is comprised between 6° and 12°.

13. Cooling assembly according to claim 12, wherein the angle is equal to 9°.

* * * * *